US008245457B2

(12) United States Patent
Eickhof

(10) Patent No.: US 8,245,457 B2
(45) Date of Patent: Aug. 21, 2012

(54) CONCEALED MOUNTING SYSTEM FOR COLUMBARIUM SHUTTERS AND THE LIKE

(75) Inventor: Paul M. Eickhof, Crookston, MN (US)

(73) Assignee: Eickhof Columbaria, Inc., Crookston, MN (US)

( * ) Notice: Subject to any disclaimer, the term of this patent is extended or adjusted under 35 U.S.C. 154(b) by 0 days.

(21) Appl. No.: 13/405,084

(22) Filed: Feb. 24, 2012

(65) Prior Publication Data

US 2012/0144769 A1 Jun. 14, 2012

Related U.S. Application Data

(62) Division of application No. 12/476,529, filed on Jun. 2, 2009, now Pat. No. 8,122,650.

(51) Int. Cl.
*E04H 13/00* (2006.01)

(52) U.S. Cl. ..... 52/134; 52/133; 52/483.1; 52/513

(58) Field of Classification Search ..... 52/128, 52/133, 134, 136, 139, 483.1, 510, 511, 513, 52/235, 486; 312/265.5, 265.6, 140, 245
See application file for complete search history.

(56) References Cited

U.S. PATENT DOCUMENTS

| | | | | |
|---|---|---|---|---|
| 3,561,182 | A * | 2/1971 | Madl | 52/479 |
| 3,888,055 | A * | 6/1975 | Gallo | 52/98 |
| 4,644,711 | A * | 2/1987 | Eickhof | 52/127.11 |
| 5,195,812 | A * | 3/1993 | Eickhof | 312/257.1 |
| 8,122,650 | B2 * | 2/2012 | Eickhof | 52/134 |

* cited by examiner

*Primary Examiner* — William Gilbert
*Assistant Examiner* — Gisele Ford
(74) *Attorney, Agent, or Firm* — Larkin Hoffman Daly & Lindgren, Ltd.; Thomas J. Oppold

(57) ABSTRACT

A concealed mounting system for columbarium shutters and the like. The mounting system includes a top clip and bottom hangers secured to a back side of the shutter. Vertically spaced upper and lower tracks are disposed behind the shutter at its upper end and a lower end. Each track includes a forwardly extending channel and a downwardly extending channel. A locking screw is received within apertures disposed substantially perpendicular to the forwardly extending channel. A nut threadably receives the locking screw and is disposed in the forwardly extending channel, whereby upon rotation of the nut, the locking screw is caused to move vertically with respect to a bottom edge of the upper track for engagement and disengagement with the top clip. The bottom hangers are operably supported by the lower track.

3 Claims, 7 Drawing Sheets

CONCEALED MOUNTING SYSTEM FOR COLUMBARIUM SHUTTERS AND THE LIKE

CROSS-REFERENCE TO RELATED APPLICATIONS

This application is a divisional of co-pending U.S. application Ser. No. 12/476,529 filed Jun. 2, 2009.

BACKGROUND

Stone shutters are removably secured to columbarium structures by a mounting system that is preferably substantially concealed or substantially hidden from view so as not to detract from the appearance of the stone and the reverent atmosphere of the columbarium. The concealed mounting system must resist corrosion and it must securely hold the shutters in position despite extreme temperature swings and countless freeze-thaw cycles for season-after-season and year-after-year, for decades, if not centuries. In addition, the mounting system must permit the shutters to be relatively easily removed and replaced even after years or decades of being exposed to the elements.

U.S. Pat. No. 4,644,711 to Eickhof discloses one type of concealed shutter mounting system that meets all of the foregoing challenges. Variations of the Eickhof '711 concealed shutter mounting system have achieved significant commercial success in the columbarium industry. However, a simpler and more cost effective concealed fastener system is needed in view of the recent trend away from using large 24"×24" stone panels and toward the use of 8"×8" individual niche shutters. The terms shutter, panel, slab and facing stone are used interchangeably throughout this specification.

A standard columbarium niche is 8"×8". Until relatively recently, it was common to use 24"×24" stone slabs with false joints cut into the finish face of the stone slab to simulate nine 8"×8" individual niche shutters. Each of the nine 8"×8" spaces on the large panel is typically engraved with a the name, birth year and death year of the deceased person whose urn resides behind that 8"×8" space. Thus, each time an urn is to be placed into one of the nine niches, or each time one of the nine niches is to be engraved, the entire 24"×24" stone panel has to be removed and then replaced. A typical 24"×24" stone panel weighs about sixty pounds. Because of the potential for misspelling of names or errors in the birth or death dates during each time the panel is engraved, it is not uncommon to have to discard and replace an entire panel due to a single mistake made when engraving one of the nine niches. Accordingly, it should be appreciated that large panels are not only difficult to handle by a single person due to their size and weight, but the use of large panels can be expensive if the panels need to be replaced due to engraving errors.

As a result of the foregoing concerns with the use of 24"×24" panels, a relatively recent trend in the columbarium industry is to use 8"×8" individual niche panels. These smaller panels are easier to handle during initial installation and when they need to be subsequently removed for engraving or when placing an urn within the niche. If there is ever an engraving error, only the single 8"×8" panel needs to be replaced instead of the entire 24"×24" panel. It should be appreciated, however, that when going from one large panel to nine smaller individual panels, all other things being equal, the amount of individual hardware pieces required to mount the panels will necessarily increase as will the amount of material costs and labor costs associated with the initial assembly of the panels and the initial mounting of the panels.

Accordingly, there is a need in the industry for a universal concealed mounting system capable of use with virtually any size columbarium shutters, but which has fewer pieces and is quicker and easier to assemble and install then currently available mounting systems in order to reduce material costs and labor costs so that even the use of smaller individual 8"×8" shutters is at least as cost effective as using larger 24"×24" panels mounted with currently available mounting systems.

DESCRIPTION

Figure 1:
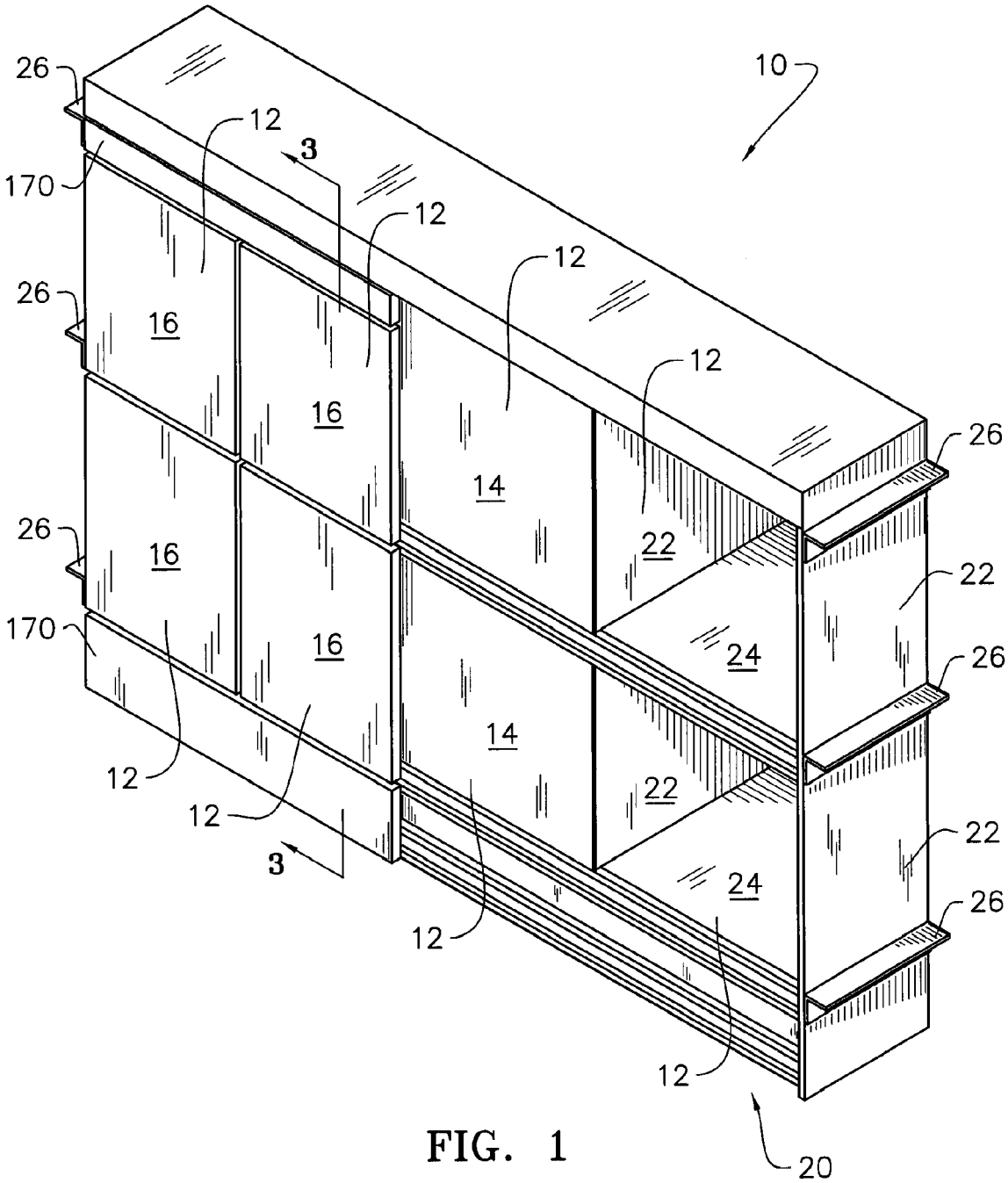
FIG. 1 is a perspective view of a columbarium comprising a plurality of niches, wherein some of the niches are open, some are shown with inner closure panels disposed over the front opening, and other niches are shown with shutters mounted utilizing an embodiment of the concealed mounting system of the present invention.

Referring now to the drawings, wherein like reference numerals designate identical or corresponding parts throughout the several views, FIG. 1 is a perspective view of a columbarium 10 comprising a plurality of niches 12 within which one or more urns 13 (FIG. 2) may be placed. Some of the niches are shown open, some are shown with inner closure panels 14 disposed over the niche opening, and other niches 12 are shown with shutters or facing stones 16 secured over the closure panels 14 utilizing a concealed fastener system 100 as described in detail later.

The columbarium 10 preferably comprises a framework 20 of horizontally spaced, vertical, planar risers 22 and vertically spaced, horizontal, planar shelves 24. As disclosed in U.S. Pat. No. 5,195,812 to Eickhof, which is incorporated herein in its entirety by reference, shelf brackets 26 and tie rods 28 (FIG. 3) secure the vertical risers 22 and horizontal shelves 24 in spaced relation to define a grid of a plurality of niches 12. As best illustrated in FIG. 3, back rails 30 are preferably secured by connectors to a back panel 32 covering the back side of the framework 20.

The back rail 30 is preferably an E-shaped extrusion, forming forwardly extending upper and lower channels 34, 36. The upper channel 34 is preferably sized to frictionally receive the back edge of the shelf 24. Serrations or ridges (not shown) may be formed in the legs of the upper channel 34 for improved frictional engagement with the shelf edge. The framework 20 is typically secured to a wall or other structure with brackets and anchors or other connectors in a conventional manner.

Figure 2:
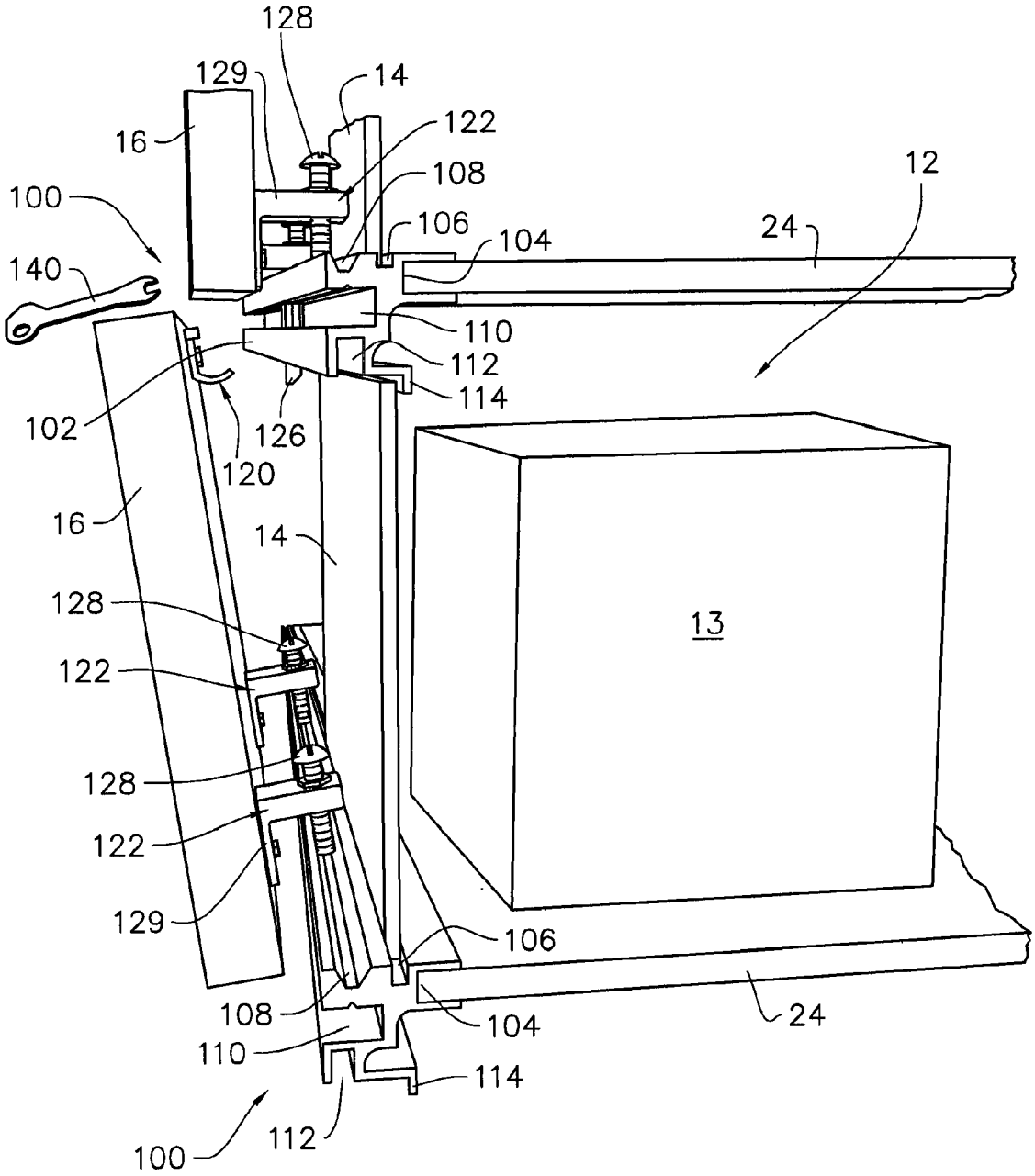
FIG. 2 is partial side perspective view of the columbarium of FIG. 1 showing a detailed view of the preferred embodiment of the concealed fastener system.
Figure 3:
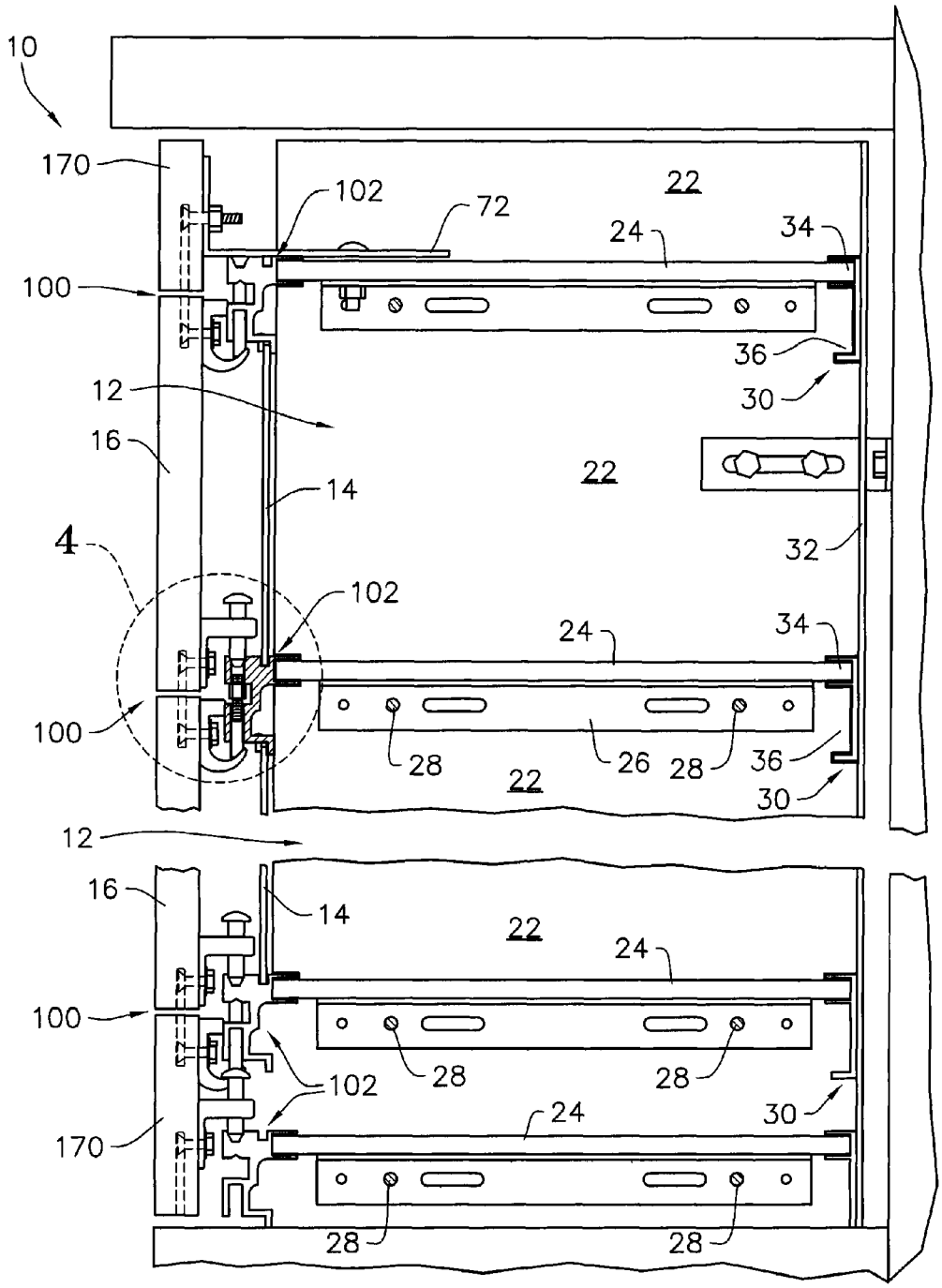
FIG. 3 is a cross-sectional view of the columbarium of FIG. 1 as viewed along lines 3-3.
Figure 4:
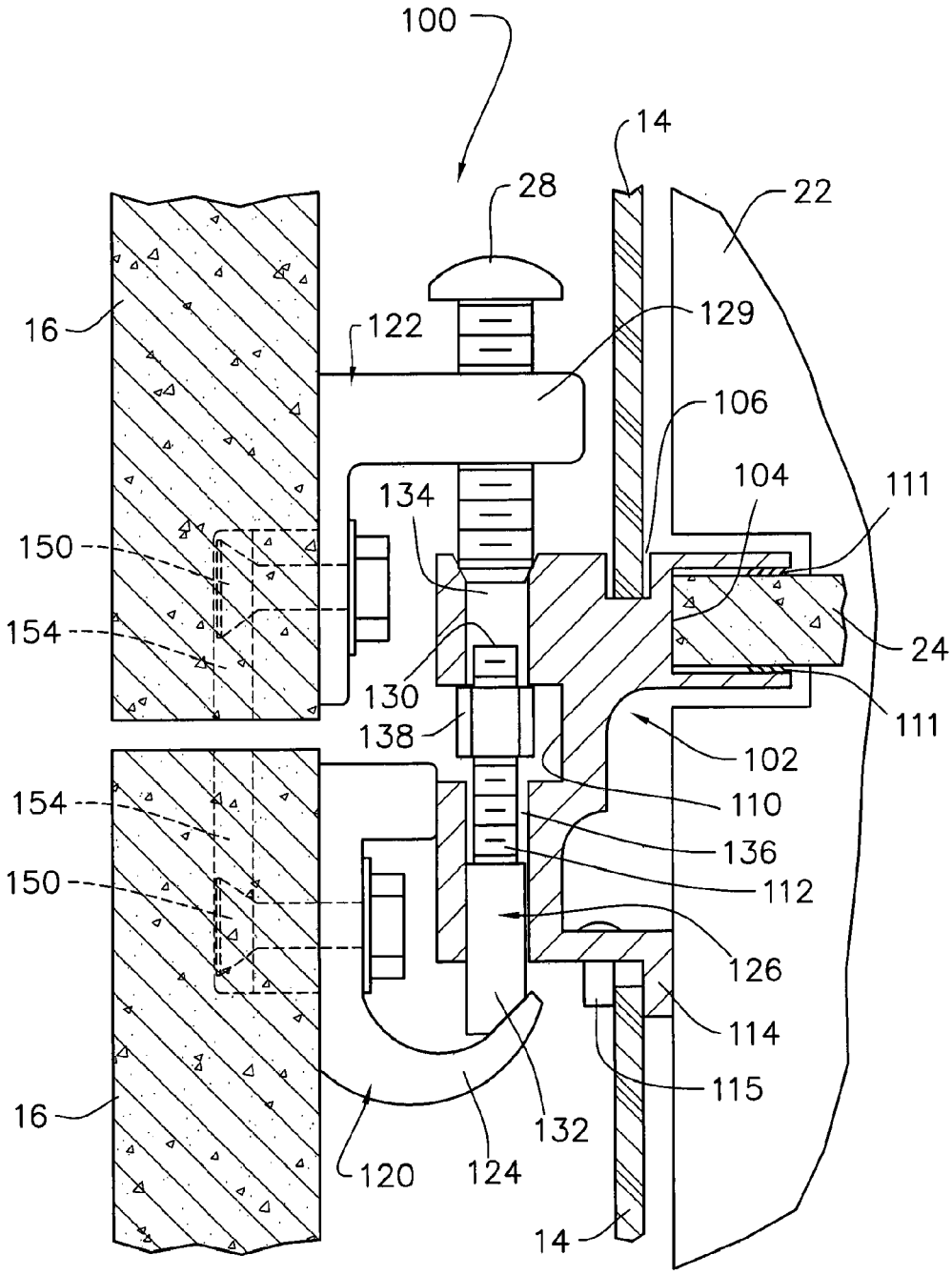
FIG. 4 is an enlarged view of the area circled in FIG. 3 showing the preferred embodiment of the concealed fastener system.
Figure 5:
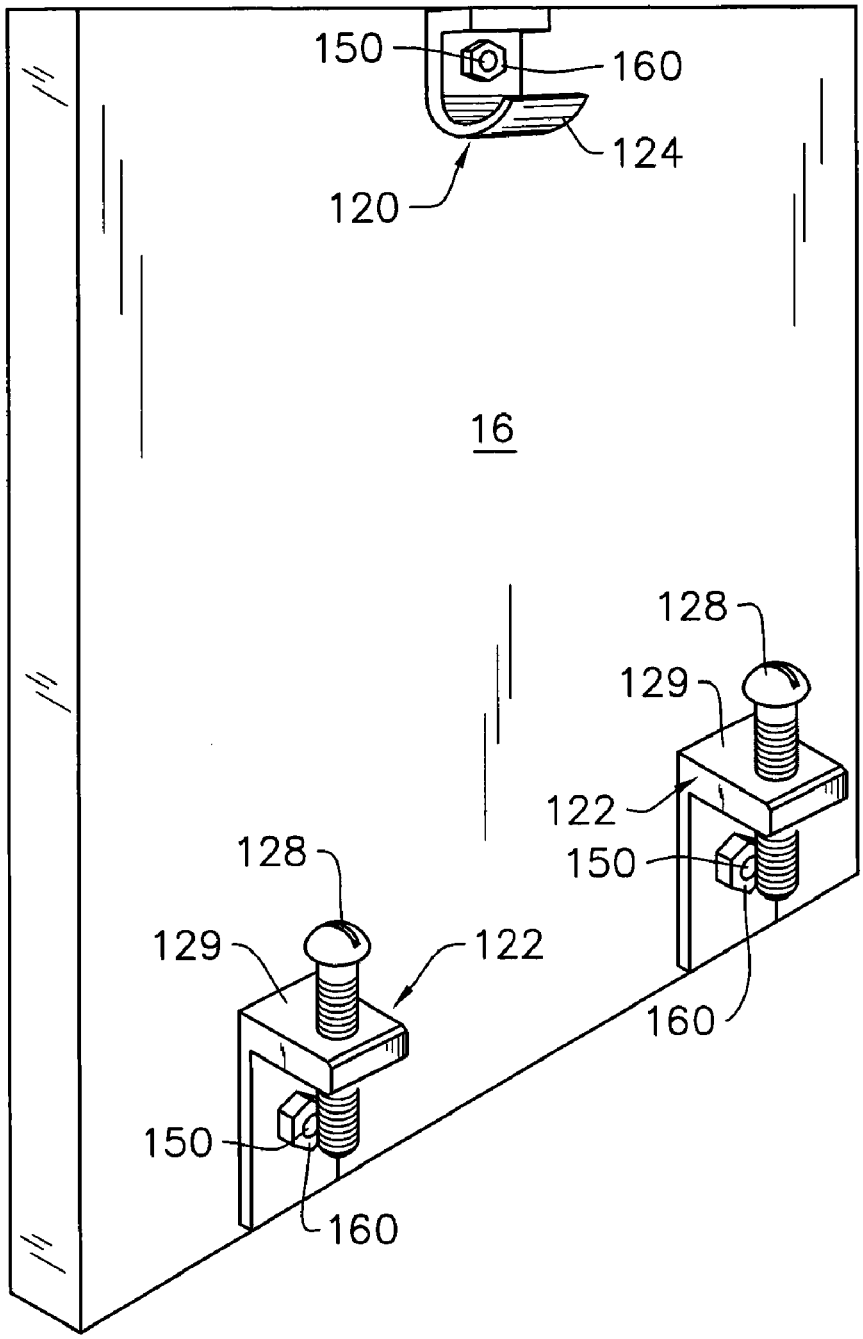
FIG. 5 is a rear perspective view of a shutter illustrating the hardware fastened to the back side of the shutter.
Figure 6:
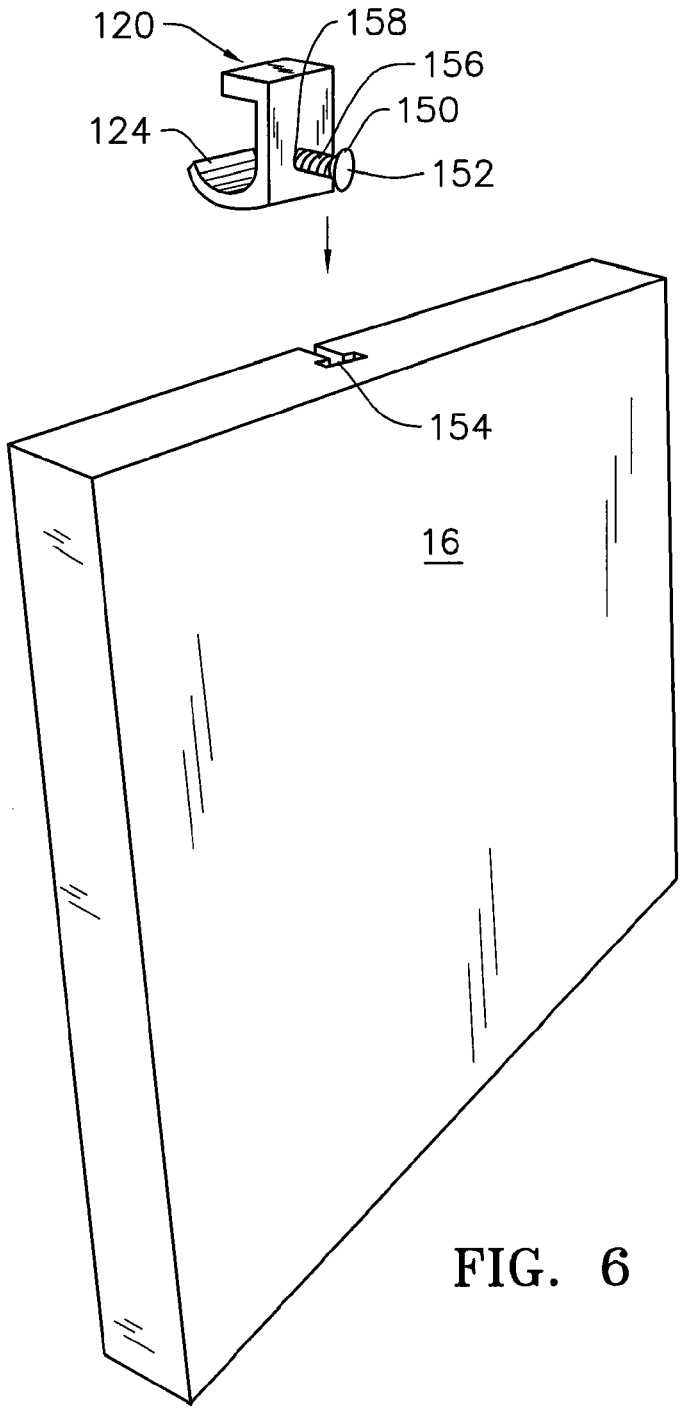
FIG. 6 is a top front perspective view of the shutter of FIG. 5 illustrating slots fabricated into the back side of the shutter to receive the anchors.
Figure 7:
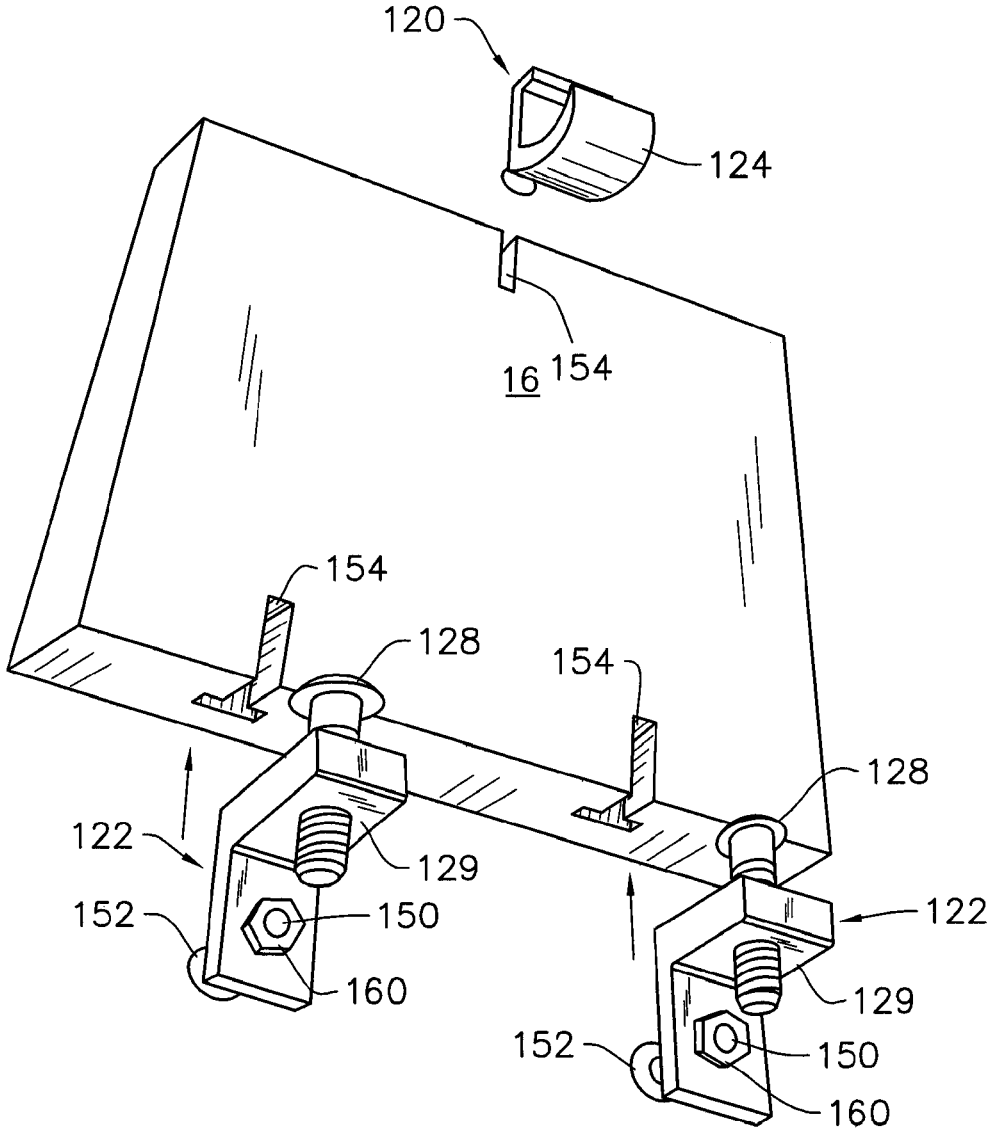
FIG. 7 is a bottom rear perspective view of the shutter of FIG. 5 illustrating slots fabricated into the back side of the shutter to receive the anchors.

A preferred embodiment of the concealed mounting system 100 is best illustrated in FIGS. 2-4. The concealed mounting system 100 includes a front track 102 that cooperates with hardware (discussed later) secured to the back side of the shutters 16. The preferred embodiment of the front track 102 includes a rearwardly extending channel 104, a top slot 106, a top groove 108, a forwardly extending channel 110, a downwardly extending channel 112 and an L-shaped flange 114. The rearwardly extending channel 104 is preferably sized to frictionally receive the front edge of the horizontal shelf 24. Serrations or ridges 111 (FIG. 4) may be formed in the upper channel 104 for improved frictional engagement with the shelf edge. As best illustrated in FIG. 3, when two front tracks 102 are disposed in vertical spaced relation, the top slot 106 of the lower front track 102 and the L-shaped flange 114 of the upper front track 102 receive and support the inner closure panels 14. As best illustrated in FIG. 4, the inner closure panels 14 are retained against the L-shaped flange preferably by spring-loaded pegs 115 or other suitable retention means spaced along the L-shaped flange 114.

Referring to FIGS. 2-5, preferably secured to the back side of the shutters 16 is an upper clip 120 and two lower support hangers 122. The upper clip 120 preferably includes an upwardly curving hook 124 that receives and is engaged by a vertically adjustable locking screw 126 (FIG. 4) that adjustably extends downwardly from the downwardly extending channel 112 (described in greater detail later). The locking screws 126 are preferably spaced along the length of the front tracks 102 at approximately the horizontal midpoint of each niche 12. The lower support hangers 122 preferably include downwardly extending, vertically adjustable threaded studs 128 threadably received by angle brackets 129. The bottom ends of the studs 128 rest within the top groove 108 vertically supporting the shutter 16. Thus it should be appreciated that by threadably adjusting the locking screw 126 and the threaded studs 128, the vertical height of the shutter 16 may be adjusted horizontally and leveled to ensure uniform gaps between adjacent shutters covering adjacent niches 12 for a more pleasing aesthetic appearance.

With reference to FIGS. 2 and 4, the locking screw 126 preferably includes a threaded upper shaft 130 and a rectangular lower shaft 132. The threaded upper shaft 130 passes through apertures 134, 136 extending through both the top groove 108 and the downwardly extending channel 112, respectively. The threaded upper shaft 130 is threadably received by a nut 138 disposed within the forwardly extending channel 110. The nut 138 is larger than the diameter of the apertures 134, 136 such that the locking screw 126 is vertically supported within the forwardly extending channel 110 by the nut 138. The width of the rectangular lower shaft 132 of the locking screw is preferably only slightly less than the width between the legs of the downwardly extending channel 112 such that rectangular lower shaft 132 prevents the locking screw 126 from rotating within the channel 112. As illustrated in FIGS. 2 and 4, the nut 138 is accessible for rotation by an open end wrench 140 (FIG. 2) inserted in the gap between vertically adjacent shutters 16. It should be appreciated that because the cooperation of the rectangular lower shaft 132 within the downwardly extending channel 112 prevents the locking screw 126 from rotating, upon turning the nut 138 clockwise using the wrench 140, the locking screw 126 is caused to move downwardly allowing the end of the rectangular lower shaft 132 to engage the upwardly curving hook 124 of the upper clip 122. Likewise, by rotating the nut 138 counter-clockwise using the wrench 140, the locking screw 126 is caused to move upwardly thereby disengaging the end of the rectangular lower shaft 132 from the upper clip 122 and allowing the shutter 16 to be easily removed for access to the niche 12. The end of the rectangular lower shaft 132 is preferably beveled to better mate with the upwardly curving hook 124.

It should be appreciated that the mounting system 100 allows more versatility than current shutter mounting systems due to the top slot 106, top groove 108 and channels 110, 112, 104 extending the full length of the track 102. Thus, the locking screws 126 can be positioned anywhere along length of the track 102 simply by drilling a hole in the desired location through the forwardly extending and downwardly extending channels 110, 112 thereby allowing the clips 120 and hangers 122 on the back of the shutters 16 to have varying positions between adjacent shutters. This versatility will permit different sized niche fronts to be used along the columbarium wall thereby avoiding the post-office-box look that is often created when an entire columbarium wall comprises a grid of 8"×8" shutters. For example, the mounting system 100 will easily allow 8"×8" single niche shutters to be positioned adjacent 8" high×16" wide shutters or vertical 16" high×8" wide shutters or even 24"×24" panels as desired. Accordingly, the mounting system 100 will allow more versatility in the configuration of niche fronts to create embellishments and introduce more and different types of stone mosaic patterns.

The upper clip 120 and lower hangers 122 are preferably secured to the back side of the shutters 16 with threaded anchors 150. In the preferred embodiment, the heads 152 of the threaded anchors 150 are received within inverted T-shaped slots 154 with the threaded shaft 156 projecting from the face of the stone. The inverted T-shaped slots 154 are preferably formed into the edges of the shutters using the apparatus and methods such as disclosed in U.S. Pat. No. 4,020,610, which is incorporated herein in its entirety by reference. The projecting threaded shafts 156 extend through apertures 158 in the clips and hangers 120, 122. Nuts 160 are threaded onto the projecting threaded shafts and are preferably tightened to approximately 95 in-pounds of torque to securely attach the clips and hangers 122 in place and to prevent their rotation.

Referring to FIG. 3, filler panels 170, such as soffit panels and bottom panels, may also be mounted using the concealed mounting system 100 where there is adequate space for the front track 102 and where the filler panels 170 are sufficiently large for mounting the clips and hangers 120, 122. If space does not permit for utilizing the concealed mounting system 100, the anchors 150 may still be secured to the back sides of the filler panels 170 using the T-shaped slots 154 to permit the panels to be bolted to an angle 172 or other suitable bracket.

The front track 112, back rail 30, anchors 150, clips 120, hangers 122, threaded studs 128, locking screws 126, brackets 26 and tie rods 28 are all preferably constructed of corrosion resistant materials, such as brass, stainless steel, aluminum or any other suitable material capable of supporting the loads anticipated for the structure and withstanding extreme environmental conditions. Similarly the risers 22, shelves 24, closure panels 14 and back panels 34 are preferably constructed of rigid, durable, weather resistant and corrosion resistant materials, such as cement fiberboard, plastic, aluminum or any other suitable materials capable of supporting the loads and environmental conditions anticipated for the structure as disclosed in U.S. Pat. No. 5,195,812 to Eickhof.

It should be appreciated that the mounting system 100 may have application outside the internment industry where a concealed mounting system is desired for security or aesthetic reasons. For example, the mounting system 100 may be used in building structures that require removable wall panels. Another application may be for removably securing protective panels over windows of buildings or houses for protection from hurricanes or high winds. Other applications may include the commercial sign industry where a concealed hardware is desirable to deter vandals and allow easy change-out of signs, advertisements, tenant directories, etc.

The foregoing description is presented to enable one of ordinary skill in the art to make and use the invention and is provided in the context of a patent application and its requirements. Various modifications to the preferred embodiment of the apparatus, and the general principles and features of the system and methods described herein will be readily apparent to those of skill in the art. Thus, the present invention is not to be limited to the embodiments of the apparatus, system and methods described above and illustrated in the drawing figures, but is to be accorded the widest scope consistent with the spirit and scope of the appended claims.

The invention claimed is:

1. A panel mounting system, comprising:

a top clip and at least one bottom hanger secured to a back side of a panel;

vertically spaced upper and lower elongated tracks disposed behind said panel, said upper elongated track proximate an upper end of said panel, said lower elongated track proximate a lower end of said panel, each of said elongated tracks having a forwardly extending elongated channel and a downwardly extending elongated channel;

a locking screw received within apertures disposed substantially perpendicular to said forwardly extending elongated channel, said locking screw having a threaded upper shaft and a rectangular lower shaft, said threaded upper shaft threadably received and supported by a nut disposed in said forwardly extending elongated channel, said rectangular lower shaft received in said downwardly extending elongated channel, whereby upon rotation of said nut, said locking screw is caused to move vertically with respect to a bottom edge of said upper elongated track for engagement and disengagement with said top clip;

said at least one bottom hanger operably supported by said lower elongated track.

2. The panel mounting system of claim 1 wherein said top clip and said bottom hangers are secured to said back side of said panel with threaded anchors, each of said threaded anchors having a head received within inverted T-shaped slots formed in said panel, a nut threaded onto each of said projecting threaded anchors secures said top clip and said bottom hangers to said back side of said panel by causing said anchor heads to be frictionally engaged with said slots.

3. The panel mounting system of claim 1 wherein each of said elongated tracks further includes a top groove and said bottom hangers include threadably adjustable studs, wherein a bottom end of said studs are received within said top groove of said lower elongated track.

* * * * *